US006479925B1

(12) United States Patent
Kim

(10) Patent No.: US 6,479,925 B1
(45) Date of Patent: Nov. 12, 2002

(54) SHADOW MASK SUPPORT FRAME FOR COLOR CATHODE RAY TUBE

(75) Inventor: Sang Kee Kim, Kyongsangbuk-do (KR)

(73) Assignee: LG Electronics Inc., Seoul (KR)

( * ) Notice: Subject to any disclaimer, the term of this patent is extended or adjusted under 35 U.S.C. 154(b) by 195 days.

(21) Appl. No.: 09/637,785

(22) Filed: Aug. 11, 2000

(30) Foreign Application Priority Data

Aug. 13, 1999 (KR) ..... 99-33434

(51) Int. Cl.[7] ..... H01J 29/80

(52) U.S. Cl. ..... 313/402; 313/404; 313/407; 313/408

(58) Field of Search ..... 313/402, 404, 313/407, 408

(56) References Cited

U.S. PATENT DOCUMENTS 5,594,300 A * 1/1997 Nosker et al. ..... 313/402

5,644,192 A * 7/1997 Ragland, Jr. ..... 313/402

* cited by examiner

*Primary Examiner*—Vip Patel
*Assistant Examiner*—Kenneth A Berck
(74) *Attorney, Agent, or Firm*—Fleshner & Kim, LLP

(57) ABSTRACT

A shadow mask support frame for a color CRT is disclosed, in which a coupling portion between a main frame and a sub frame, and a shape of the sub frame are improved to increase the frequency of unique oscillation, thereby reducing a howling phenomenon occurring in a shadow mask. The shadow mask support frame for a color CRT includes: two main frames having hollow sections; two sub frames having solid sections, end portions respectively fixed into respective end portions of the main frames, a support portion inwardly extended with a predetermined length at an obtuse angle to the end portions, and a central portion inwardly extended with a predetermined length at an obtuse angle to the support portion; and a bracket mounted between respective end portions of the main frames and the sub frames, for reinforcing fixing portions of the main frames and the sub frames.

10 Claims, 7 Drawing Sheets

SHADOW MASK SUPPORT FRAME FOR COLOR CATHODE RAY TUBE

BACKGROUND OF THE INVENTION

1. Field of the Invention

The present invention relates to a shadow mask support frame for a color cathode ray tube (CRT), in which a shadow mask is supported with tension.

2. Background of the Related Art

Generally, a shadow mask support frame for a color CRT supports a shadow mask that acts to selectively pass through an electron beam, so as to prevent the shadow mask from being oscillated due to external shock or sound wave. The shadow mask support frame also supports the shadow mask to maintain a predetermined distance from a fluorescent screen to land the electron beam passed through an electron beam passing hole of the shadow mask on a predetermined phosphor.

FIG. 1 is a partially exploded side view of a related art color CRT incorporating a shadow mask support frame. Referring to FIG. 1, the related art color CRT includes a flat panel 1 on which a dot type fluorescent screen 2 having R, C, B colors is coated, a shadow mask 4 having an electron beam passing hole 4 a that acts to selectively pass through an electron beam 3 incident upon the fluorescent screen 2, a funnel 5 coupled to the rear of the panel 1, a neck portion 5*a* formed at the rear of the funnel 5, an electron gun (not shown) mounted into the neck portion 5*a*, for emitting the electron beam, a deflection yoke 6 for deflecting the electron beam surrounding an outside of the funnel 5, a shadow mask support frame 7 for supporting the shadow mask 4, a spring 8 mounted in the shadow mask support frame 7, a stud pin 9 fixed into the panel 1 to be coupled to the spring 8, for supporting the shadow mask support frame 7, and an inner shield 10 formed at the rear of the shadow mask support frame 7, for shielding earth-magnetic field so as not to allow the electron beam 3 to be susceptible to external earth-magnetic field when the CRT is operating.

The operation of the aforementioned color CRT will be described.

The electron beam emitted from the electron gun is horizontally/vertically deflected by magnetic field of the deflection yoke 6 and scanned on the shadow mask 4. Then, the electron beam selectively passes through the electron beam passing hole 4*a* of the shadow mask 4. At this time, the electron beam passing hole 4*a* of the shadow mask 4 and the fluorescent screen 2 coated on the flat panel 1 are set to geometrically match with each other. Accordingly, when the electron beam 3 passes through the electron beam passing hole 4*a*, the electron beam 3 is landed on the fluorescent screen 2 to emit light on the fluorescent screen 2. A picture image is displayed by emitting light on the fluorescent screen 2. The picture image can be displayed with a predetermined color purity only when the electron beam 3 is accurately landed on the fluorescent screen 2.

However, when the electron beam 3 passes through the electron beam passing hole 4*a* of the shadow mask 4, the shadow mask 4 emits heat so that the shadow mask 4 is thermally expanded. This is called a doming phenomenon.

Afterwards, heat of the shadow mask 4 is transferred to the as shadow mask support frame 7 so that the shadow mask support frame 7 is thermally expanded. This results in that the electron beam passing hole 4*a* of the shadow mask 4 is deviated from a preset position. Therefore, even if the electron beam 3 passes through the electron beam passing hole 4*a*, the electron beam 3 fails to be landed on the predetermined fluorescent screen 2, thereby causing color purity on a screen any adverse effect.

Meanwhile, if outwardly provided oscillation or impact is applied to the shadow mask support frame 7 and the shadow mask 4 through the panel 1 and the stud pin 9, a howling phenomenon of the shadow mask 4 occurs. The howling phenomenon moves the position of the electron beam passing hole 4*a* of the shadow mask 4, thereby causing color purity any adverse effect in the same manner as the doming phenomenon.

Moreover, as a curvature radius of the shadow mask becomes flat recently, the shadow mask has a poorer rigidity than a spheric shadow mask. This seriously causes the doming phenomenon and the howling phenomenon.

To solve such a problem, as shown in FIGS. 2 to 5, there are provided shadow mask support frames according to first to third embodiments of the related art, in which tension is applied to the shadow mask 4 to absorb thermal expansion of the shadow mask due to the doming phenomenon and reduce oscillation due to the howling phenomenon.

Referring to FIGS. 4 to 6, the related art shadow mask support frame 7 includes two main frames 71 arranged in a row, and two sub frames 72 arranged in a row to be orthogonal to the main frames 71, having both end portions fixed to respective end portions of the main frames 71. Thus, the shadow mask support frame 7 has a square frame shape.

The aforementioned shadow mask support frame 7 is compressed in a length direction (Y direction) of the sub frame 72 by a separate compression equipment. In this state, both sides of the shadow mask 4 are fixed on the main frame 71, and then compression load is eliminated. Thus, the main frame 71 and the sub frame 72 are restored to their original positions by elastic force. As a result, the shadow mask 4 is subject to tension in Y direction.

Since the tension applied to the shadow mask absorbs thermal expansion of the shadow mask 4, the doming phenomenon can be avoided to some extent. However, the tension applied to the shadow mask could not completely remove the howling phenomenon due to structural characteristic of the shadow mask support frame 7 as described later.

The shadow mask support frames 7 according to the first to third embodiments of the related art have the frequency of primary unique oscillation, inertia moment values, compression load values, and weight values of the shadow mask support frame 7, respectively, as shown in Table 1 below.

TABLE 1

| item | first embodiment of the related art | second embodiment of the related art | third embodiment of the related art |
|---|---|---|---|
| the frequency of primary unique oscillation | 100% | 124% | 136% |
| inertia moment of main frame | 100% | 85% | 120% |
| inertia moment of sub frame | 100% | 204% | 100% |
| compression load required for tension | 100% | 96% | 100% |
| weight of shadow mask support frame | 100% | 57% | 114% |

The frequency X of unique oscillation of the shadow mask support frame 7 is expressed by the following equation.

$$\omega = \sqrt{\frac{K}{\rho}} \propto \sqrt{\frac{EI}{\rho l^4}}$$

Where, ω is the frequency of unique oscillation of the support frame, K is frame rigidity, ρ is a density (frame mass), E is elastic coefficient, I is inertia moment, and L is a frame length.

In the above equation, the following relationship is obtained.

$$\omega IK$$

In the support frame structure having the same material, the same length, and the same elastic coefficient, if the inertia moment increases, rigidity increases with the frequency of unique frame oscillation. If the frequency of unique frame oscillation increases, the resonation range to external oscillation having a certain area or impact is reduced, thereby improving howling characteristic.

However, in the first embodiment of the related art as shown in FIGS. 2A to 2C, supposing that the shadow mask support frame 7 has a characteristic value of 100%, there is a problem that compression load and weight required for tension of the shadow mask 4 increase.

Furthermore, in the second embodiment of the related art as shown in FIGS. 3A to 3C, the shadow mask support frame 5 has a high inertia moment value for the sub frame 72 but a low inertia moment value for the main frame 71. This causes twist moment to be weakened, thereby causing poor howling characteristic.

In the third embodiment of the related art disclosed in the Japanese Patent Publication No. 5-258677, as shown in FIG. 4, the main frame 71 has a triangle shaped hollow section and the sub frame 72 has a solid section. Since the sub frame 72 has end portions bent orthogonally, the frequency of primary unique oscillation and the inertia moment of the main frame 71 can be improved. However, the weight of the shadow mask support frame 5 increases, thereby reducing unique oscillation characteristic.

SUMMARY OF THE INVENTION

Accordingly, the present invention is directed to a shadow mask support frame for a color CRT that substantially obviates one or more of the problems due to limitations and disadvantages of the related art.

An object of the present invention is to provide a shadow mask support frame for a color CRT in which a coupling portion between a main frame and a sub frame, and a shape of the sub frame are improved to increase the frequency of unique oscillation, thereby reducing a howling phenomenon occurring in a shadow mask.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a shadow mask support frame for a color CRT according to the present invention includes: two main frames having hollow sections; two sub frames having solid sections, end portions respectively fixed into respective end portions of the main frames, a support portion inwardly extended with a predetermined length at an obtuse angle to the end portions, and a central portion inwardly extended with a predetermined length at an obtuse angle to the support portion; and a bracket mounted between respective end portions of the main frames and the sub frames, for reinforcing fixing portions of the main frames and the sub frames.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
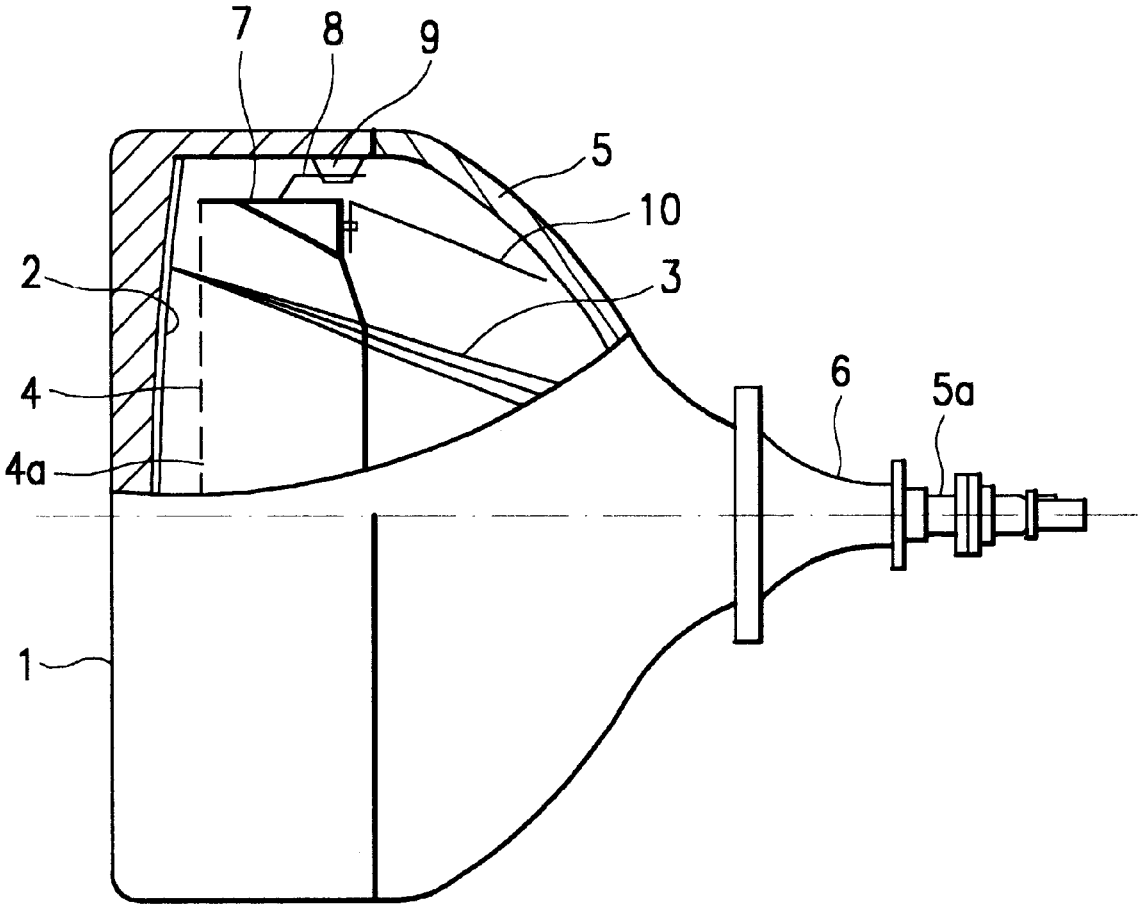
FIG.1 Prior Art
FIG. 1 is a partially exploded side view of a related art color CRT incorporating a shadow mask support frame.
Figure 2A:
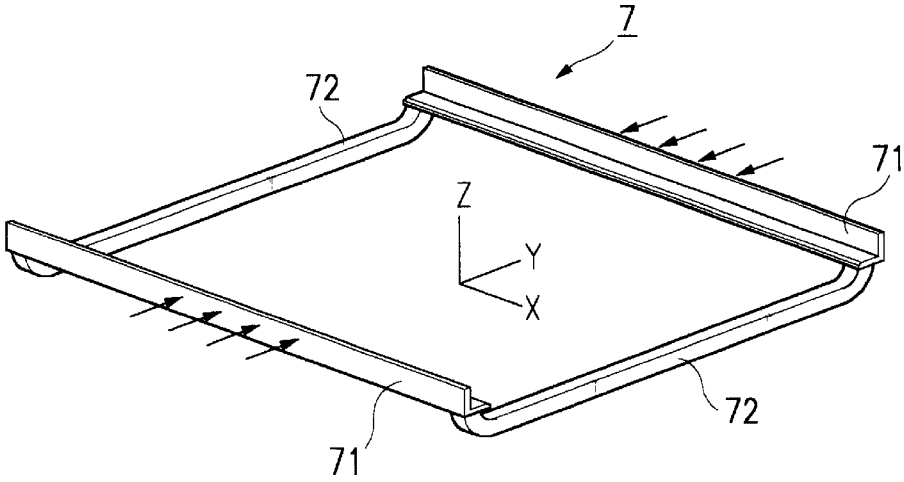
FIG.2A Prior Art
FIG. 2A is a perspective view of a shadow mask support frame for a color CRT according to the first embodiment of the related art.
Figure 2B:
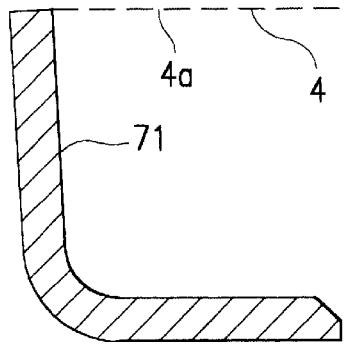
FIG.2B Prior Art
FIG. 2B is a longitudinal sectional view of a main frame of FIG. 2A.
Figure 2C:
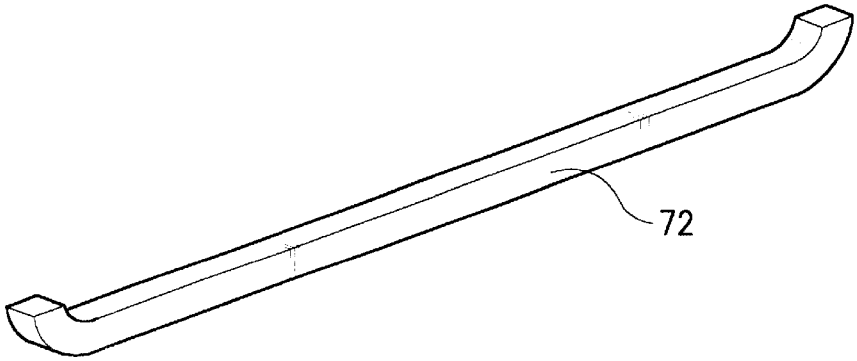
FIG.2C Prior Art
FIG. 2C is a perspective view of a sub frame of FIG. 2A.
Figure 3A:
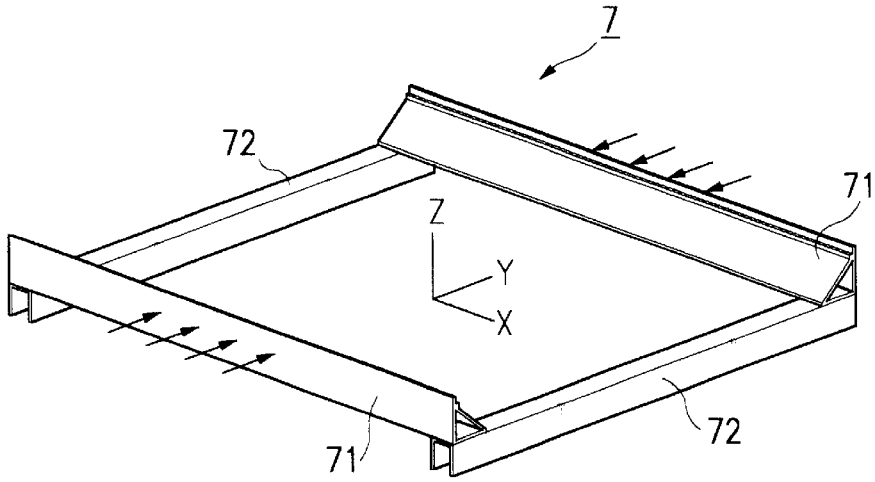
FIG.3A Prior Art
FIG. 3A is a perspective view of a shadow mask support frame for a color CRT according to the second embodiment of the related art.
Figure 3B:
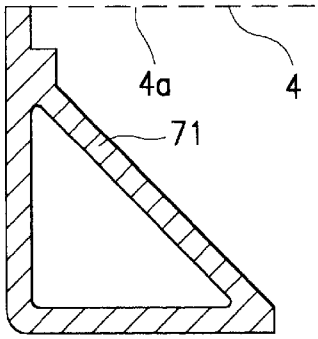
FIG.3B Prior Art
FIG. 3B is a longitudinal sectional view of a main frame of FIG. 3A.
Figure 3C:
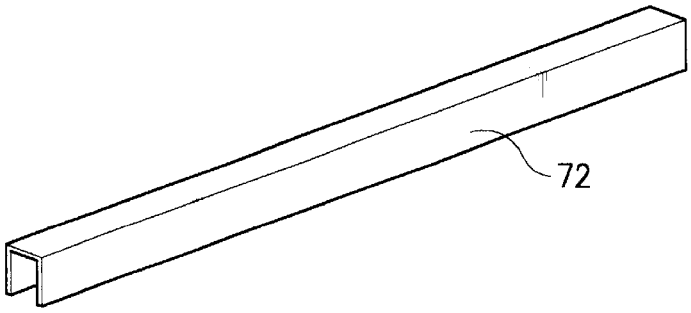
FIG.3C Prior Art
FIG. 3C is a perspective view of a sub frame of FIG. 3A.
Figure 4:
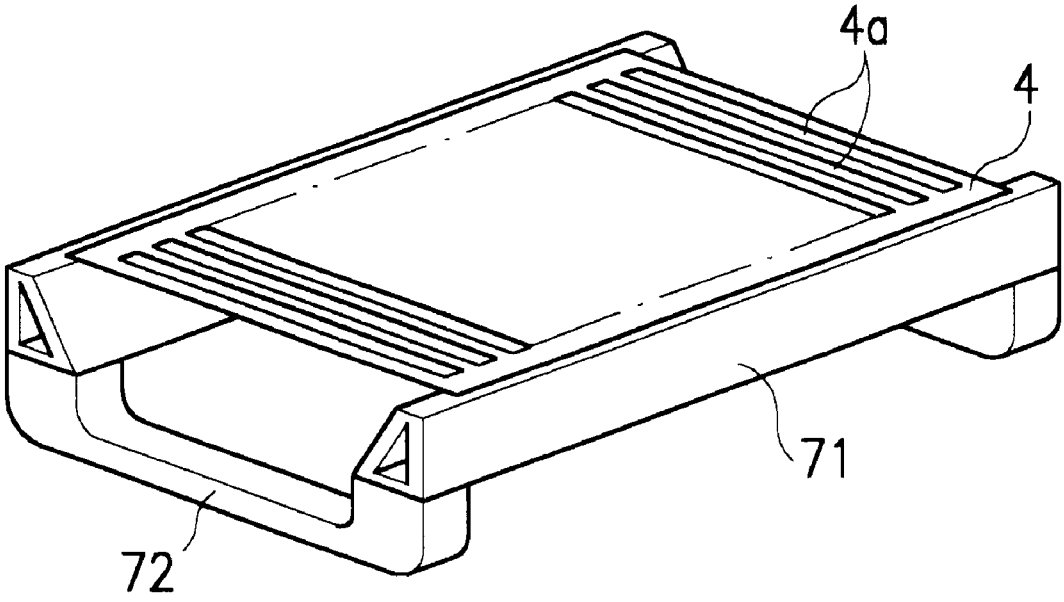
FIG.4 Prior Art
FIG. 4 is a perspective view of a shadow support frame for a related art color CRT.
Figure 5A:
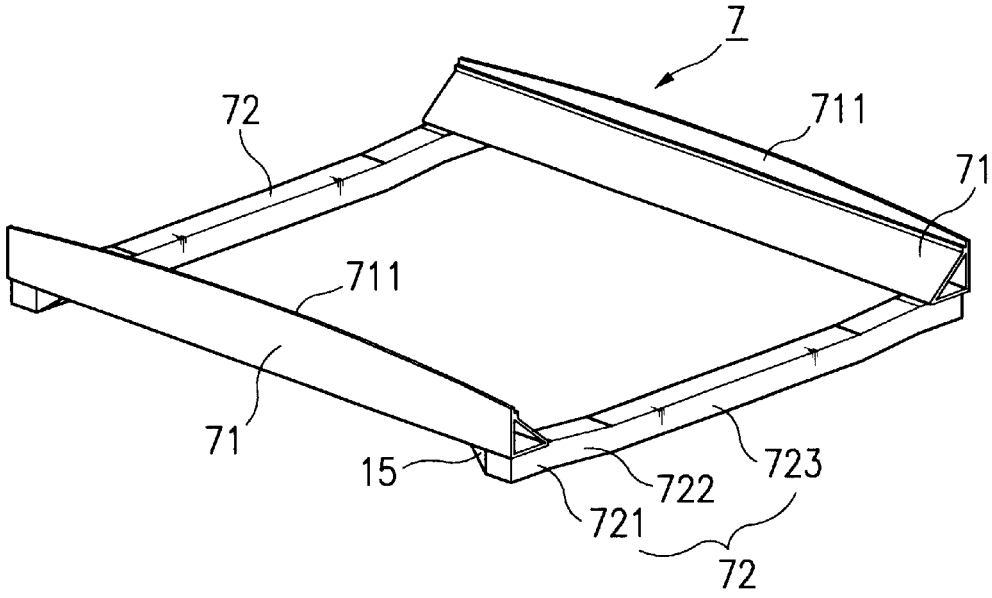
FIGS. 5A and 5B are perspective views of a shadow mask support frame for a color CRT according to the present invent ion.
Figure 5B:
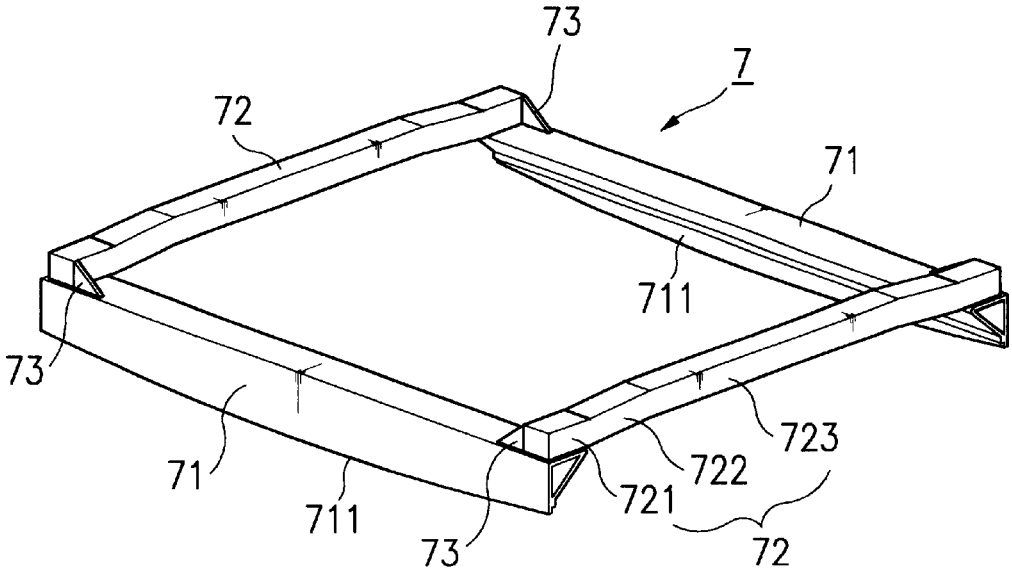
Figure 6A:
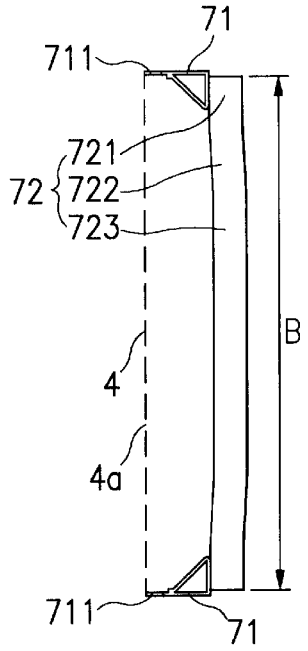
FIGS. 6A, 6B and 6C are a front view, a plane view and a side view of a shadow mask support frame for a color CRT according to the present invention.
Figure 6B:
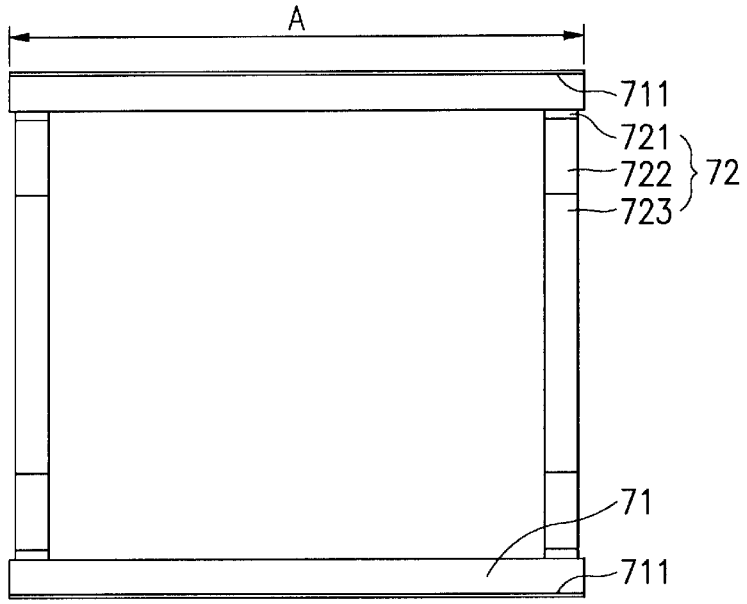
Figure 6C:
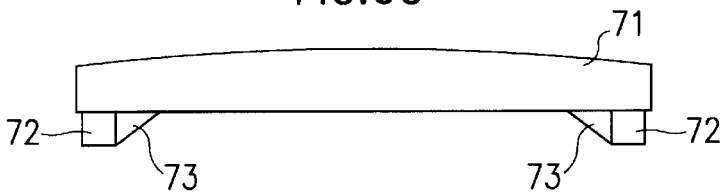
Figure 7:
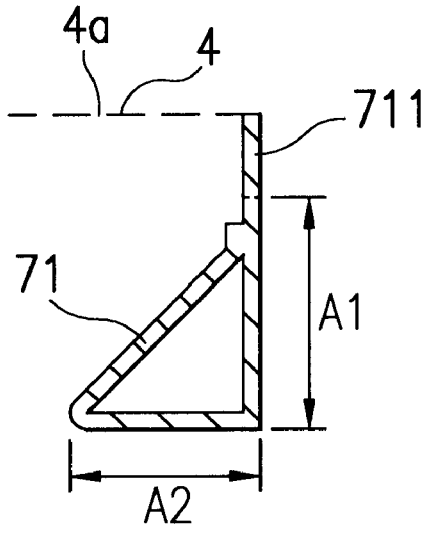
FIG. 7 is a longitudinal sectional view of a main frame according to the present invention.
Figure 8:
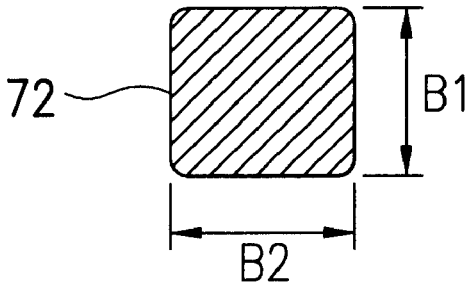
FIG. 8 is a longitudinal sectional view of a sub frame according to the present invention.

A shadow mask support frame for a color CRT according to the present invention will be described with reference to FIGS. 5 to 8.

The shadow mask support frame 7 of the present invention includes two main frames 71 having right triangle shaped hollow sections and two sub frames 72 having square shaped solid sections. The main frames 71 are arranged in parallel and have a rib 711, on which a shadow mask 4 will be mounted, extended along a vertical side of the right triangle. The sub frame 72 includes end portions 721 respectively fixed into respective end portions of the main frames 71, a support portion 722 inwardly extended with a predetermined length at an obtuse angle to the end portions 721, and a central portion 723 inwardly extended with a predetermined length at an obtuse angle to the support portion 722. Since the support portion 722 is obtuse to the end portion 721 and the central portion 723, inertia moment resistant to deformation increases, thereby increasing rigidity.

Furthermore, a bracket 73 is mounted between respective end portions of the main frames 71 and the sub frames 72. The bracket 73 is in contact with a lower side of the main frame 71 and an inner side of the sub frame 72, thereby reinforces fixing portions of the main frames 71 and the sub frames 72. Also the bracket 73 reinforces twist moment of the shadow mask support frame 7, the frequency of unique oscillation in oscillation characteristic can be increased. Such increase of the frequency of unique oscillation reduces the frequency of howling peak which occurs only within a certain range, thereby improving howling characteristic.

Detailed design dimensions of the shadow mask support frame according to the present invention are as follows.

It is defined that the length of the main frame 71 is A, its height is A1, its lower side width is A2, and that the length of the sub frame 72 is B, its height is B1, and its width is B2. In this case, a ratio of the height and width of the right triangle hollow section is in the range of 0.9~1.05, and a ratio of the height and width of the sub frame 72 is in the range of 0.6~0.9.

In the shadow mask support frame for a color CRT according to the present invention, as shown in Table 2, inertia moment of the main frame 71 and inertia moment of the sub frame 72 are improved by 159% and 20%, respectively, the frequency of unique oscillation increases by 67%, compression load required for tension decreases by 14%, and a weight of the support frame decreases by 5%. Thus, oscillation characteristic can be improved.

TABLE 2

| item | first embodiment of the related art | second embodiment of the related art | third embodiment of the related art | present invention |
|---|---|---|---|---|
| the frequency of primary unique oscillation | 100% | 124% | 136% | 167% |
| inertia moment of main frame | 100% | 85% | 120% | 259% |
| inertia moment of sub frame | 100% | 204% | 100% | 120% |
| compression load required for tension | 100% | 96% | 100% | 86% |
| weight of support frame | 100% | 57% | 114% | 95% |

As aforementioned, the shadow mask support frame for a color CRT has the following advantages.

Since the sub frame has square shaped solid sections, and the end portions and the support are bent to form an obtuse angle, inertia moment resistant to deformation of the shadow mask support frame can be improved, thereby improving rigidity of the support frame.

Furthermore, since the bracket that acts as a reinforcing member is fixed into the fixing portion between the main frame and the sub frame, twist moment of the shadow mask support frame can be improved, thereby increasing the frequency of unique oscillation of the shadow mask support frame and improving howling characteristic.

It will be apparent to those skilled in the art that various modifications and variations can be made in the apparatus for compensating for corner focus and brightness in a CRT according to the present invention without departing from the spirit or scope of the invention. Thus, it is intended that the present invention covers the modifications and variations of the invention provided they come within the scope of the appended claims and their equivalents.

What is claimed is:

1. A shadow mask support frame for a CRT, comprising:

two main frames having hollow sections;

two sub frames having solid sections, end portions respectively fixed to respective end portions of the main frames, support portions each having a predetermined length and extending inwardly at an obtuse angle from the respective end portions, and a central portion extending between the support portions a predetermined length at an obtuse angle with respect to the support portions; and a bracket mounted between respective end portions of the main frames and the sub frames, for reinforcing fixing portions of the main frames and the sub frames.

2. The shadow mask support frame of claim 1, wherein the hollow sections of the main frames comprise right triangle-shaped hollow sections and a rib, on which a shadow mask will be mounted, that extends along a vertical side of the right triangle, while the solid sections of the sub frames comprise square-shaped solid sections.

3. The shadow mask support frame of claim 1, wherein the bracket is fixed to lower sides of the main frames and inner sides of the sub frames.

4. The shadow mask support frame of claim 1, wherein a ratio of a height and width of the right triangle-shaped hollow sections of the main frames is in a range of approximately 0.9~1.05 and a ratio of a height and width of the sub frame is in a range of approximately 0.6~0.9.

5. A CRT, comprising:

a panel;

a fluorescent screen coated on the panel;

a shadow mask which selectively allows an electron beam to pass therethrough and hit the fluorescent screen;

a funnel coupled to a rear of the panel;

a neck portion formed at a rear of the funnel;

an electron gun positioned in the neck portion for emitting the electron beam;

a deflection yoke for deflecting the electron beam surrounding an outside of the funnel; and a shadow mask support frame for supporting the shadow mask, comprising:

a plurality of main frames; and a plurality of sub frames attached respectively to end portions of the plurality of main frames, wherein the plurality of sub frames each have end portions, support portions each extending linearly at an obtuse angle from an inner end of a respective one of the end portions, and a central portion extending between respective inner ends of the support portions at an obtuse angle with respect to the support portions.

6. The shadow mask support frame of claim 5, wherein the hollow sections of the main frames comprise tight triangle-shaped hollow sections and a rib, on which a shadow mask will be mounted, that extends along one side of the right triangle, while the solid sections of the sub frames comprise square-shaped solid sections.

7. The shadow mask support frame of claim 5, further comprising a bracket mounted between respective end portions of the main frames and the sub frames.

8. The shadow mask support frame of claim 7, wherein the bracket is fixed to lower sides of the main frames and inner sides of the sub frames.

9. The shadow mask support frame of claim 5, wherein a ratio of a height and width of the right triangle-shaped hollow sections of the main frames is in a range of approximately 0.9~1.05 and a ratio of a height and width of the sub frame is in a range of approximately 0.6~0.9.

10. The shadow mask support frame of claim 5, wherein the shadow mask frame is for a color CRT.

* * * * *